US007936318B2

(12) United States Patent
Kwan et al.

(10) Patent No.: US 7,936,318 B2
(45) Date of Patent: May 3, 2011

(54) ANTENNA WITH MULTIPLE FOLDS

(75) Inventors: Philip Pak-Lin Kwan, Beaverton, OR (US); Paul Beard, Milpitas, CA (US)

(73) Assignee: Cypress Semiconductor Corporation, San Jose, CA (US)

( * ) Notice: Subject to any disclaimer, the term of this patent is extended or adjusted under 35 U.S.C. 154(b) by 21 days.

(21) Appl. No.: 11/048,999

(22) Filed: Feb. 1, 2005

(65) Prior Publication Data

US 2006/0170598 A1 Aug. 3, 2006

(51) Int. Cl.
*H01Q 9/30* (2006.01)
*H01Q 1/24* (2006.01)

(52) U.S. Cl. ..... 343/895

(58) Field of Classification Search ..... 343/700 MS, 343/702, 803, 804, 895
See application file for complete search history.

(56) References Cited

U.S. PATENT DOCUMENTS

| | | | | |
|---|---|---|---|---|
| 5,604,505 | A * | 2/1997 | Matterer | 343/772 |
| 5,668,560 | A * | 9/1997 | Evans et al. | 343/702 |
| 5,926,139 | A * | 7/1999 | Korisch | 343/702 |
| 5,929,825 | A * | 7/1999 | Niu et al. | 343/895 |
| 5,966,097 | A | 10/1999 | Fukasawa et al. | |
| 6,166,694 | A * | 12/2000 | Ying | 343/702 |
| 6,424,299 | B1 * | 7/2002 | Cha et al. | 343/700 MS |
| 6,518,937 | B2 * | 2/2003 | Fang | 343/895 |
| 6,535,172 | B2 * | 3/2003 | Hirabayashi | 343/700 MS |
| 6,738,023 | B2 * | 5/2004 | Scott et al. | 343/700 MS |
| 6,894,647 | B2 * | 5/2005 | Jenwatanavet | 343/700 MS |
| 6,894,846 | B1 * | 5/2005 | He et al. | 359/722 |
| 7,088,299 | B2 * | 8/2006 | Siegler et al. | 343/702 |
| 7,148,846 | B2 * | 12/2006 | Qi et al. | 343/700 MS |
| 7,180,465 | B2 * | 2/2007 | Lynch et al. | 343/702 |
| 7,319,432 | B2 * | 1/2008 | Andersson | 343/702 |
| 2001/0043159 | A1 | 11/2001 | Yoshiyuki et al. | |
| 2002/0024466 | A1 | 2/2002 | Yoshiyuki et al. | |
| 2003/0016177 | A1 * | 1/2003 | Deguchi et al. | 343/702 |
| 2003/0025637 | A1 * | 2/2003 | Mendolia et al. | 343/702 |
| 2004/0070541 | A1 * | 4/2004 | Andersson et al. | 343/702 |
| 2004/0075613 | A1 | 4/2004 | Jarmuszewski et al. | |
| 2004/0145527 | A1 * | 7/2004 | Mikkola | 343/700 MS |

FOREIGN PATENT DOCUMENTS

| | | |
|---|---|---|
| DE | 10319093 | 11/2004 |
| EP | 1291964 | 3/2003 |
| EP | 1476919 | 8/2003 |
| JP | 05-22018 | 1/1993 |
| JP | 05-259724 | 10/1993 |

OTHER PUBLICATIONS

International Search Report, mailed Apr. 7, 2006, for related International Patent Application No. PCT/US06/03653, filed Feb. 1, 2006, 2 pages.

International Preliminary Report on Patentability, mailed Aug. 7, 2007, for related International Patent Application No. PCT/US06/03653, filed Feb. 1, 2006, 6 pages.

Supplementary European Search Report, for related European Patent Application No. 06720133.5, filed Feb. 1, 2006, 3 pages.

Examination Report, mailed Jul. 10, 2008, for related European Patent Application No. 06720133.5, filed Feb. 1, 2006, 4 pages.

* cited by examiner

*Primary Examiner* — Douglas W Owens
*Assistant Examiner* — Minh D A

(57) ABSTRACT

A wireless device has a module with a communications port and an antenna electrically coupled to the communications port, the antenna having multiple folds. The antenna has a shunt stub connected to a ground plane and a radiating portion that has multiple folds, or wiggles, allowing good electrical performance to be achieved with a minimal size.

18 Claims, 6 Drawing Sheets

ANTENNA WITH MULTIPLE FOLDS

BACKGROUND

1. Technical Field

This disclosure relates to wireless devices, more particularly to antenna used in wireless devices.

2. Background

Wireless devices send and receive signals through an antenna. For transmission, the antenna converts electrical signals from a power amplifier to electro-magnetic fields and radiates those fields out in a desired manner. When receiving, the antenna receives radiated electro-magnetic fields and converts them back to electrical signal for interpretation and operation by the wireless device.

Many different types of antenna are being used in wireless applications. A common one is an inverted 'F' antenna. It has two 'fingers' that provide electrical connection to the wireless device, and a long, straight arm that typically parallels an edge of the printed circuit board upon which the wireless device is mounted. The inverted F antenna provides good electrical performance, but has a rather large physical size. Another option is an antenna that is shaped similar to a 'question mark,' but the physical size is comparable to the inverted F antenna.

Wireless devices, because of their freedom from cables and wires, are particularly suited for small, portable implementations. One of the main physical constraints on making the device smaller is the size of the antenna. However, smaller antennas need to be able to match the electrical performance of the larger antenna.

SUMMARY

One embodiment of the invention is a wireless device has a module with a communications port and an antenna electrically coupled to the communications port, the antenna having multiple folds.

Another embodiment of the invention is an antenna having a shunt stub connected to a ground plane and a radiating portion that has multiple folds, or wiggles, allowing good electrical performance to be achieved with a minimal size.

Another embodiment of the invention is a method of manufacturing an antenna with multiple folds.

BRIEF DESCRIPTION OF THE DRAWINGS

Embodiments of the invention may be best understood by reading the disclosure with reference to the drawings, wherein.

DETAILED DESCRIPTION OF THE EMBODIMENTS

Figure 1:
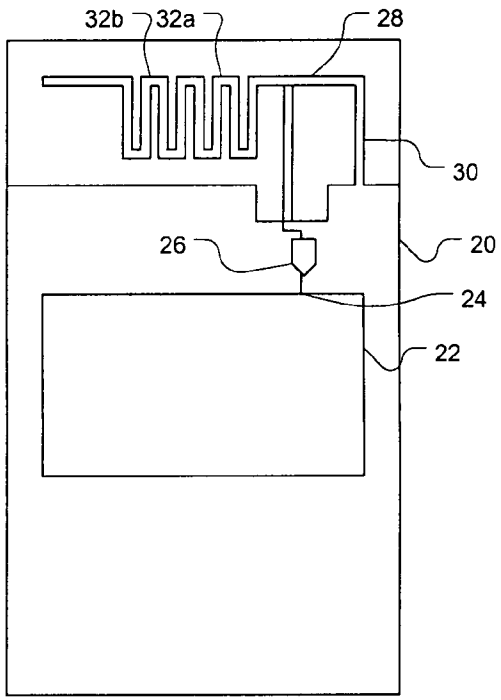
FIG. 1 shows an inverted F antenna.

An embodiment of an inverted F antenna is shown in FIG. 1. The substrate 10 has mounted on it a module 12. The substrate may be a printed circuit board, or equivalent, such as a layered ceramic substrate. The substrate provides electrical connections for the module to allow it to be connected to power, communications and other types of traces in the substrate. For example, this substrate may have an edge connector 15 that allows the substrate to be inserted into a slot on a larger substrate, such as a mother board. The mother board provides power, ground and signals to the individual conductors such as 17 of the edge connector. These conductors are then connected through traces on the substrate to the module.

The substrate may also provide a conductor 14 between a connector 16 for the inverted F antenna 18. The shunt stub 19 provides the connection between the radiating portion of the antenna and the module 12. The connector 16 would comprise a communications port that allows the module 12 to provide signals to be radiated out of the antennas, and to allow the module 12 to receive signals from the antenna for conversion and operation.

As can be seen in FIG. 1, the size of the substrate 10 is largely dependent upon the size of the inverted F antenna 18. This is due to the necessary size of the antenna to provide good electrical performance. As mentioned previously, it is generally desirable to reduce the size of wireless modules and the antenna is one of the main physical constraints on the size.

An alternative design is an antenna shaped much like a question mark,'?' However, the necessary size of this antenna is similar to that of the inverted F antenna, constraining the size of the unit to be of a larger-than-desirable size.

Figure 2:
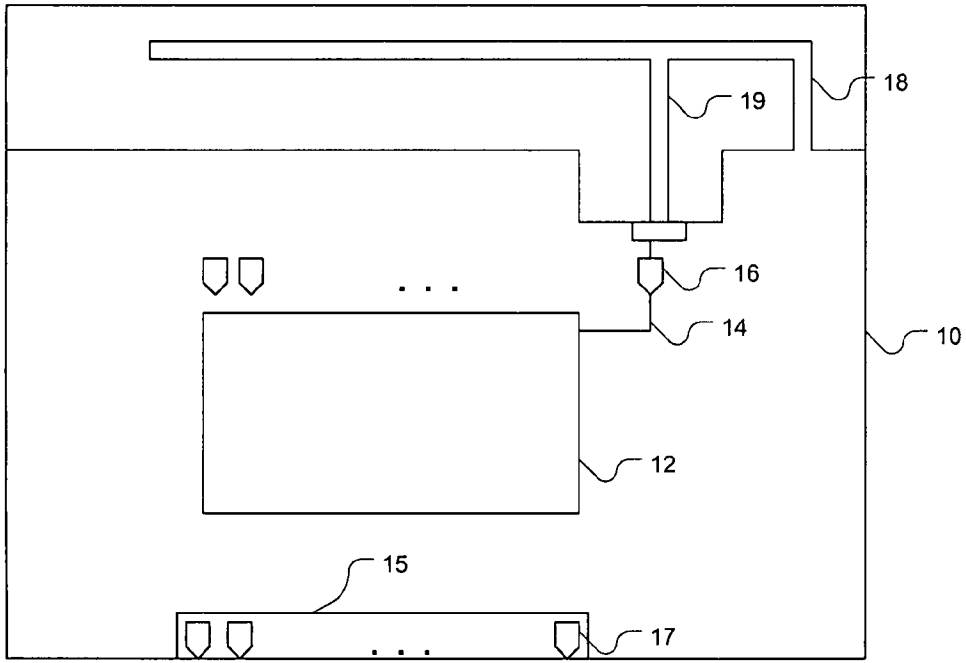
FIG. 2 shows an embodiment of a substrate having a module and an antenna having multiple folds.

In FIG. 2, an embodiment of an antenna having multiple folds is shown. This may be referred to as a 'wiggle' antenna. The actual sizes of the modules and antennas may vary, but the comparative sizes between them can be seen by comparing FIGS. 1 and 2. In this embodiment, the two substrates have a similar vertical extent, but the folded antenna substrate shown in FIG. 2 has less than half the horizontal extent of the inverted F antenna substrate.

In FIG. 2, the substrate 20 has a module 22 with connectors such as 26. A conductor 24 connects the module 22 to the connector 26, although the actual conductor may not be seen if it is buried in the layers of the substrate. The conductor 24 provides a communications port for the module 22. In one embodiment the module 22 is a Universal Serial Bus (USB) module that communicates with other devices using the USB communications protocol. The substrate 20 may or may not have other features, such as the edge connector of substrate 10 shown in FIG. 1.

The antenna 28 has multiple folds, such as 32*a* and 32*b*. The embodiment of FIG. 2 has a vertical shunt stub 30. The selection of a vertical shunt stub or a horizontal shunt stub is left up to the system designer, and the selection of a vertical shunt stub in this particular embodiment is merely for demonstration purposes only. Examples of horizontal and vertical shunt stub configurations are shown in FIGS. 3 and 4.

Figure 3:
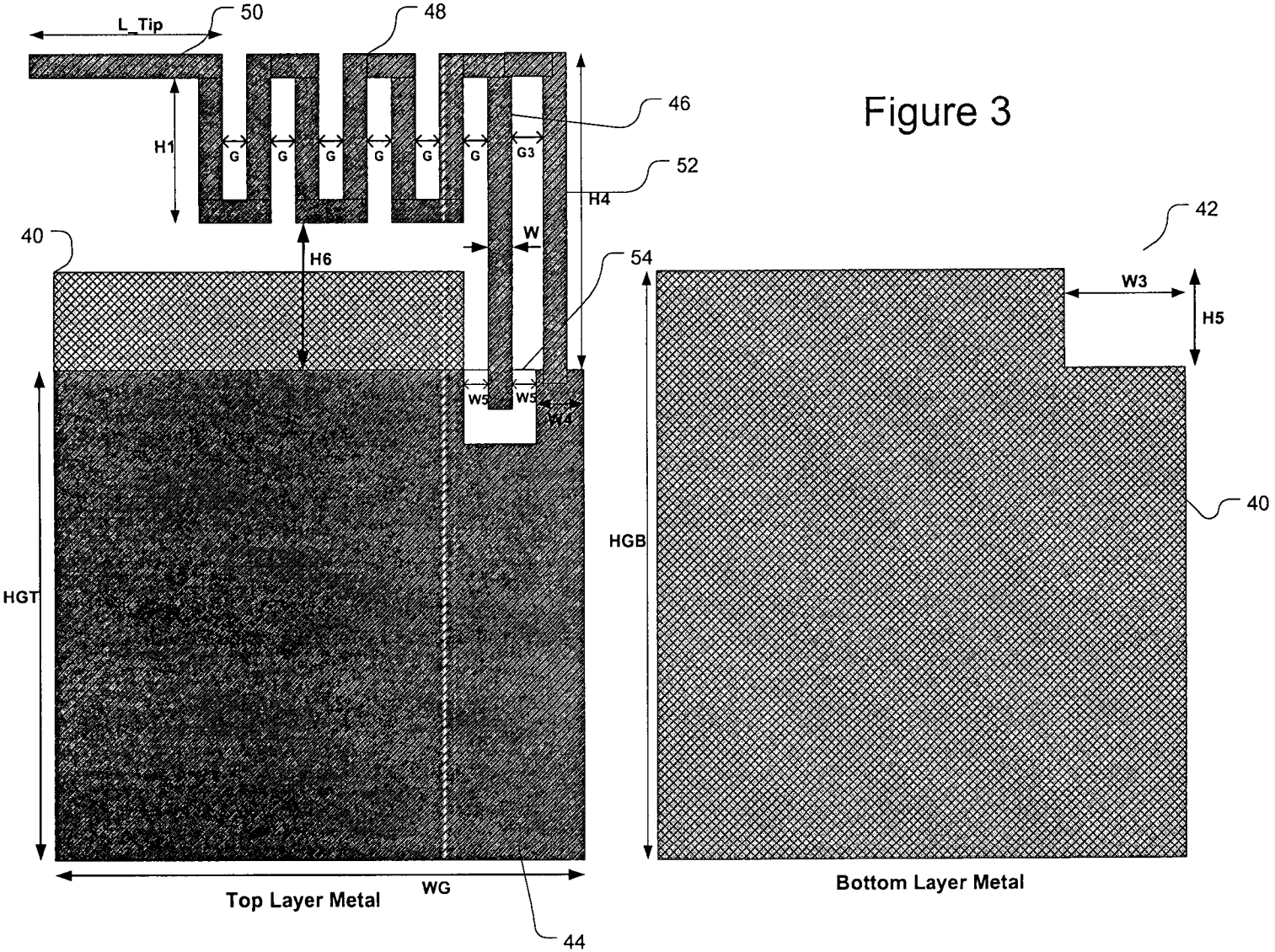
FIG. 3 shows an embodiment of an antenna having multiple folds and a vertical shunt stub.
Figure 4:
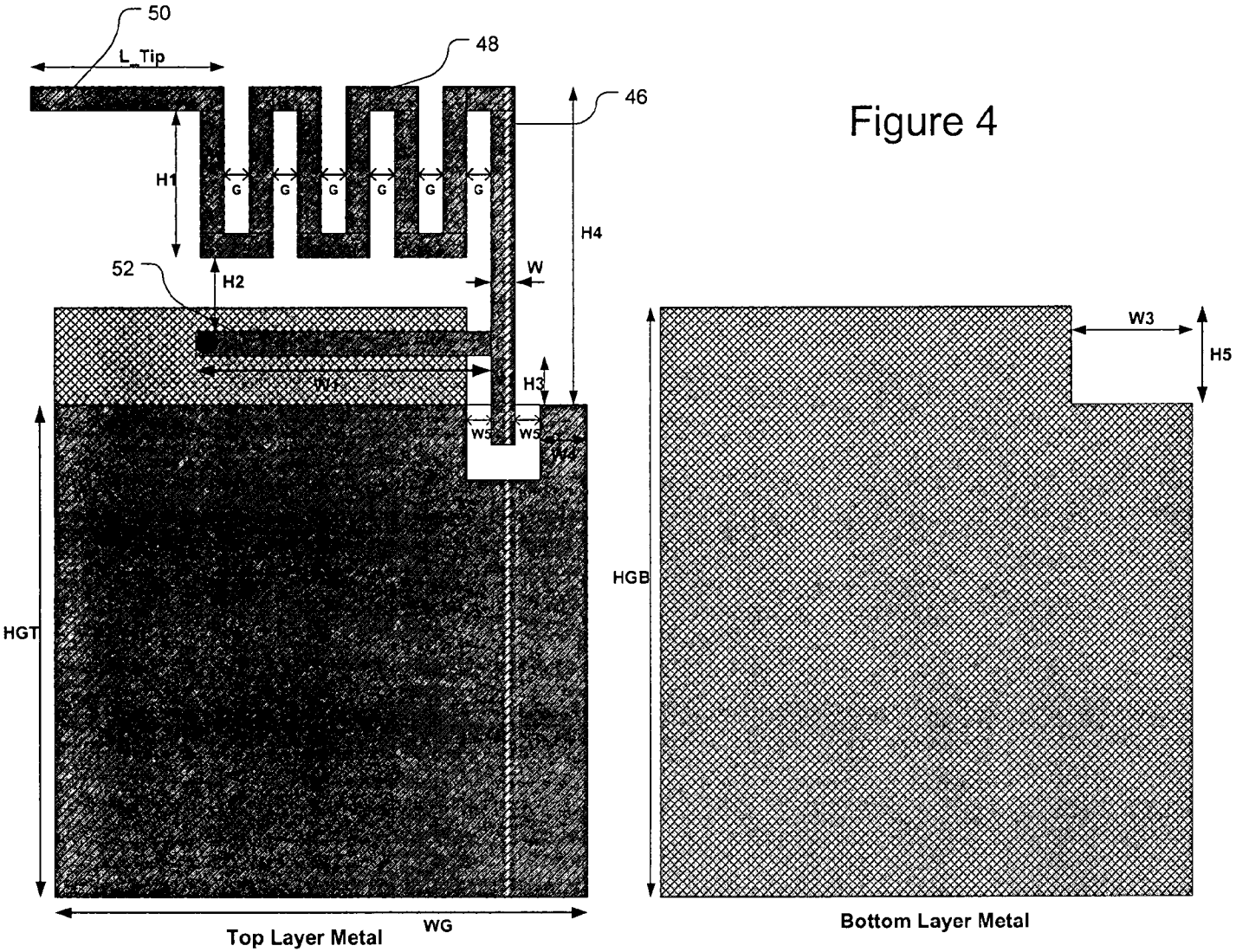
FIG. 4 shows an embodiment of an antenna having multiple folds and a horizontal shunt stub.

FIG. 3 shows a vertical shunt stub wiggle antenna. The antenna is manufactured out of a substrate that has a bottom layer metal 40 and a top layer metal 44. The bottom layer metal is shown on the left right. It has a HGB. A notch 42 having a height H5 and a width W3 is shown in this embodiment as being in the upper right hand corner of the bottom layer metal. This is merely for demonstrative purposes and the notch can be provided in any position in the bottom layer metal that will allow proper connection of the antenna.

The antenna in this embodiment is formed out of the top layer metal 44 as shown on the left. The top layer metal has a height HGT that may be less than that of the bottom layer metal height HGB. The radiating portion of the antenna has a connecting arm 46 that connects via a connector pad 54. The antenna has multiple folds such as 48, each spaced a distance G apart and having an interior height of H1, spaced from the bottom layer metal a distance H2.

The connecting arm and the width of the folds of the antenna are generally the same, shown here as width W. The exterior height of the antenna would therefore be the interior height H1 plus the width of the antenna itself at the top of the folds, W. The antenna has a tip 50, having a length L_tip. The individual selection of these dimensions is left up to the designer and the constraints of the module for which the antenna is being designed.

In this embodiment the shunt stub 52 is a vertical shunt stub. The shunt stub 52 is spaced a distance G3 from the first of the antenna folds. The shunt stub 52 will typically be as wide as the folds of the antenna, for ease of manufacturing. In this embodiment, it can be seen that the bottom of the folds of the antenna are spaced a distance H6 from the top layer of metal 44. For comparative purposes, the distance H6 in FIG. 3 is substantially equal to the distance H3+W+H2 of FIG. 4.

In addition to the radiating portion of the antenna, the antenna has a shunt stub 52. In one embodiment the radiating portion and the shunt stub are manufactured out of the same layer. No limitation that these structures be manufactured separately should be inferred. As can be seen in FIG. 3, the shunt stub 52 is connected to the bottom layer metal 40. This provides an extended ground plane for the antenna. The extended ground plane improves the antenna return loss and bandwidth control. Return loss is typically defined as the difference, usually expressed in decibels (dB), compared between the incident voltage or current on a transmission line and the reflected current or voltage as measured at a particular point. This will be discussed further with regard to FIG. 5. The position and size of the shunt stub also assists in achieving the desired resonant behavior.

Figure 5:
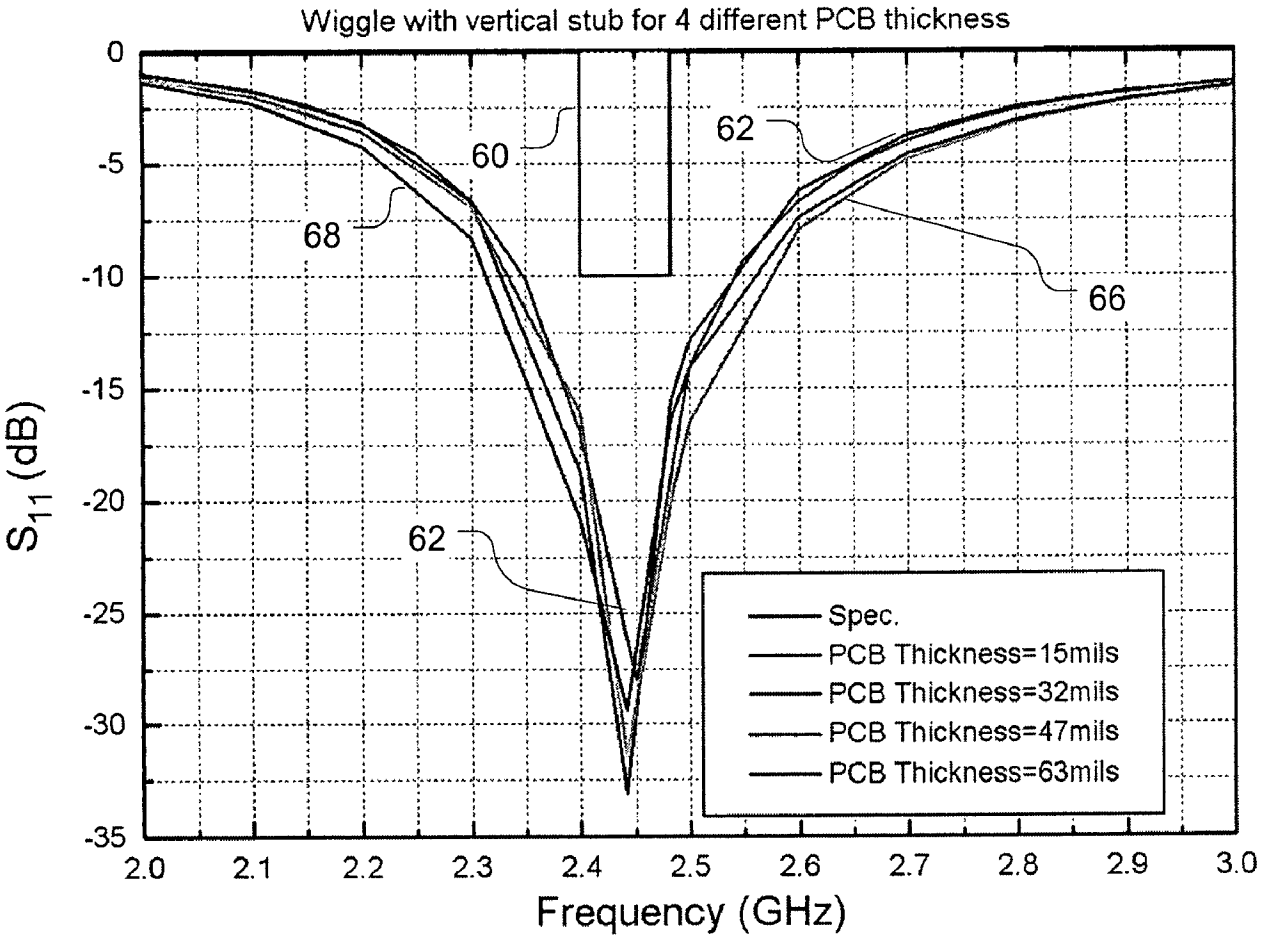
FIG. 5 shows a graph of antenna return loss versus frequency for different substrate thicknesses.

With regard to bandwidth control, the bandwidth control may be improved by the distance between the top layer and the bottom layer of metal in the substrate. This distance is referred to as the offset. There is an optimum offset for a given frequency and a given substrate thickness. The ground offset acts as a tuning element for the antenna, similar to a tuning capacitor. The performance of a wiggle antenna at different board thicknesses is shown in FIG. 5.

In FIG. 4, an embodiment of an antenna with a horizontal shunt stub is shown. In this embodiment, the connecting arm of the antenna 46 is connected to the pad 54 and the folds of the antenna 48 are spaced apart a distance G, as in the horizontal embodiment shown in FIG. 4. Shunt stub 52 is spaced above the top layer of metal 44 by a distance H3, and from the bottom of the folds of the antenna by a distance H2.

As discussed above with regard to FIG. 4, the use of a wiggle antenna reduces the size of the antenna, while still providing good return loss performance. FIG. 5 shows a graph of return loss versus frequency for four different thicknesses of substrates. In this graph, the substrates were printed circuit boards, but no limitation of the use of PCBs as the substrate is intended or implied.

On the graph, curve 60 is the performance specification for return loss. Curve 62 is the return loss performance for a wiggle antenna on a substrate thickness of 15 mils. It must be noted that the thickness of the substrate is the separation between the top layer metal and the bottom layer metal. Curve 64 is for a substrate that is 32 mils thick. Curve 66 is for a substrate that is 47 mils thick and curve 68 is for a substrate that is 63 mils thick. As can be seen by these results, the return loss is more than satisfactory for a wiggle antenna.

The wiggle antenna manufacture is not much more complicated than the manufacture of an inverted F antenna or similar construction, such as a question mark antenna. The process will be discussed relative to the bottom layer metal and the top layer metal shown in FIGS. 3 and 4.

Figure 6B:
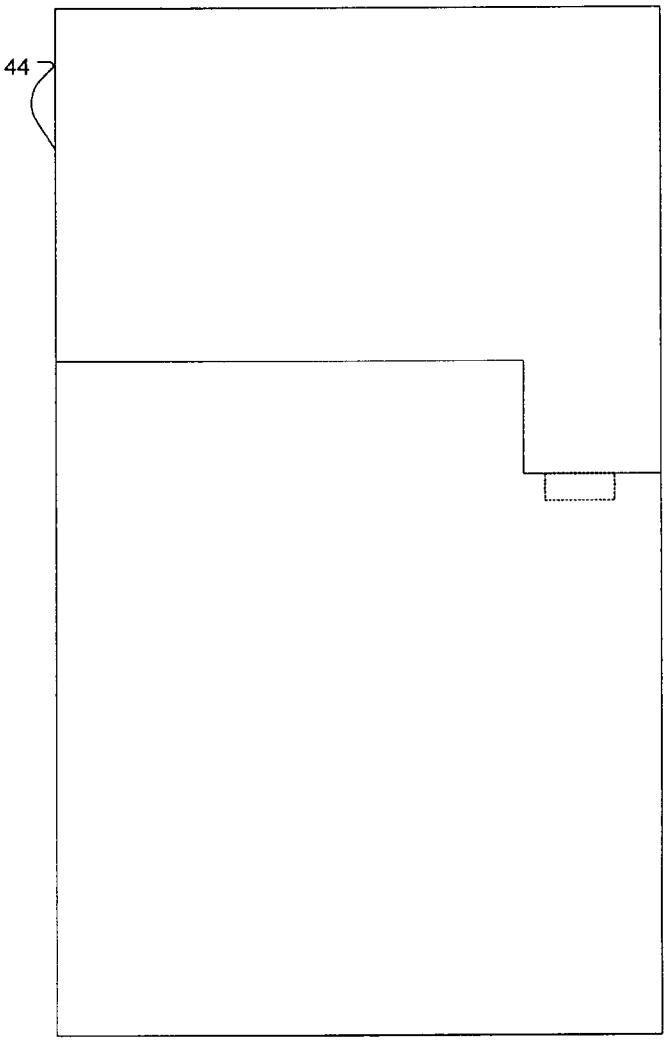
FIGS. 6*a*-6*d* show a flowchart of an embodiment of a method to manufacture an antenna having multiple folds on a substrate.
Figure 6A:
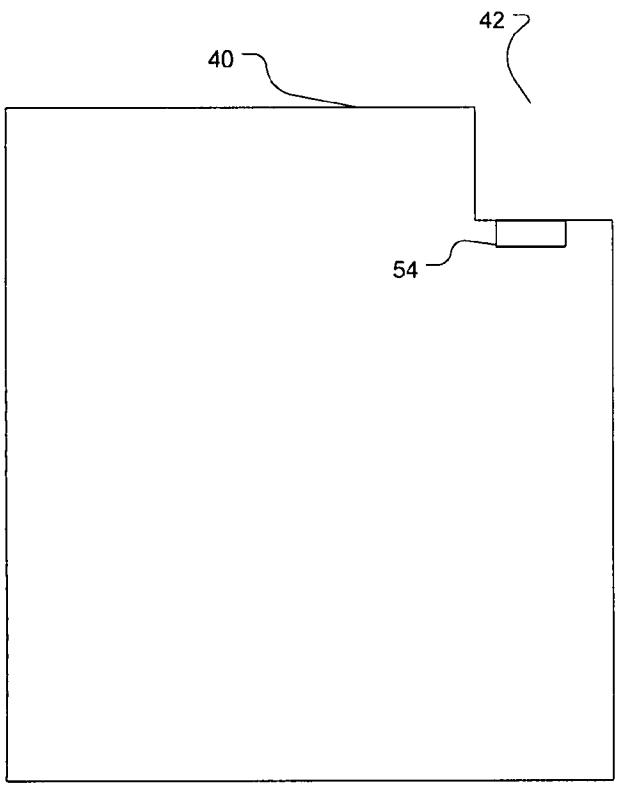

In FIG. 6*a*, bottom layer metal 40 is shown with the notch 42 in the upper left hand corner. As mentioned previously, the notch may be located at any position as desired by the system designer and for ease of manufacturing. In FIG. 6*a*, the contact pad 54 is provided, adjacent the notch 42.

When top metal layer 44 is formed or otherwise provided, it results in the structure shown in FIG. 6*b*. In one embodiment, where the antenna is formed out of the top layer metal, the top layer of metal may cover all the bottom layer of metal from this view. As discussed with regard to FIGS. 3 and 4, the dimensions of the folds of the antenna may be uniform. This allows the metal to be patterned and etched with fewer steps.

For example, assume a process where the metal is patterned with a UV-cured mask. The photoresist or other masking material is formed on the top layer of the metal. Using reticles to form the appropriate patterns, the photoresist is cured in a pattern such as the one shown in FIG. 6*c*. The uniformity of the structure dimensions allows fewer reticles to be used and easier step-and-repeat processes to form the folds of the antenna.

Figure 6D:
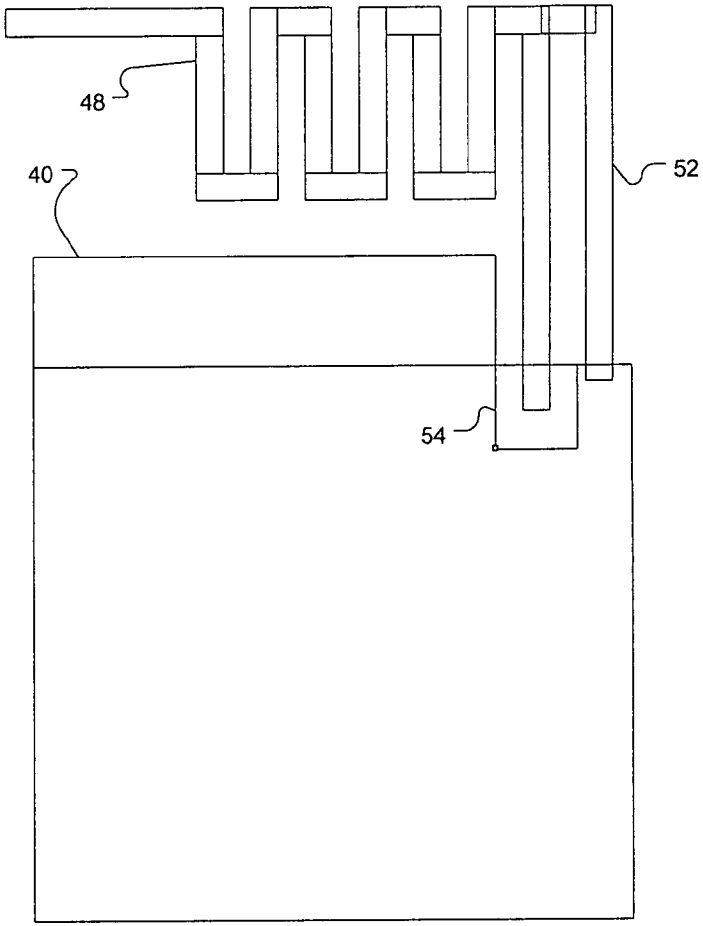
Figure 6C:
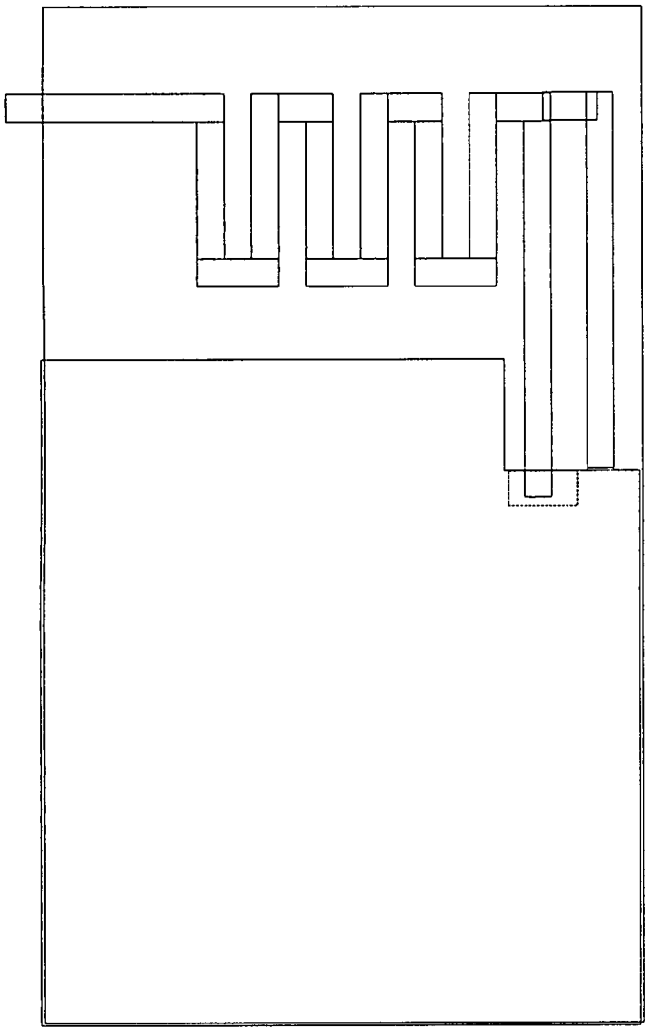

In FIG. 6*d*, the metal that is exposed is etched and the mask cleaned away, leaving the structures shown in FIG. 3. The antenna 48 is connected to the conductor pad 54, and the vertical stub 52 is connected to the bottom layer metal 40. The process for the vertical stub antenna would be very similar. As mentioned above, the discussion of the antenna may refer to a radiating portion and a shunt stub as though they were separate structures. However, in reality, these structures may be formed out of the same layer of metal at the same time.

In this embodiment, the antenna was formed in the top layer of metal and the bottom layer of metal is used for the ground plane. However, the reverse could also be implemented. The basic process would be to form a layer of metal on a substrate and then pattern and etch the metal to form the antenna with multiple folds. The metal layer from which the antenna is formed could be the top layer or the bottom layer.

For example, the metal layer formed on the substrate could be the bottom metal layer formed directly on the substrate. Alternatively, the metal layer could be the top metal layer formed on the substrate overlying other layers, including the bottom metal layer. It seems to result in a simpler manufacturing flow to use the top layer for the antenna and the bottom layer for the ground plane, but the process may be adjusted as necessary by the system designer.

The wiggle antenna has several advantages. The smaller size allows the overall unit to be smaller, as is desirable in wireless devices. The use of the extended ground plane on the front (top layer) or back (bottom layer) of the substrate provides improved return loss performance. Similarly, the extended ground plane allows better bandwidth control. The position and size of the shunt stub can be manipulated to allow for a particular resonant behavior.

It should be appreciated that reference throughout this specification to "one embodiment" or "an embodiment" means that a particular feature, structure or characteristic described in connection with the embodiment is included in at least one embodiment of the present invention. Therefore, it is emphasized and should be appreciated that two or more references to "an embodiment" or "one embodiment" or "an alternative embodiment" in various portions of this specification are not necessarily all referring to the same embodiment. Furthermore, the particular features, structures or characteristics may be combined as suitable in one or more embodiments of the invention.

Similarly, it should be appreciated that in the foregoing description of exemplary embodiments of the invention, various features of the invention are sometimes grouped together in a single embodiment, figure, or description thereof for the purpose of streamlining the disclosure aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment.

What is claimed is:

1. A wireless device, comprising:

a module having a communications port that is connected to a connector pad; and an antenna formed in a first metal layer on a substrate electrically coupled to the communications port, the antenna having a radiating portion having multiple folds, a connecting arm coupled between a first end of the radiating portion and the connector pad, and a shunt stub, wherein the shunt stub is coupled between the first end of the radiating portion and an extended ground plane that is formed in a second metal layer in the substrate, the shunt stub having a width that is approximately equal to a width of the radiating portion of the antenna, and wherein the shunt stub is substantially linear.

2. The wireless device of claim 1, the module further comprising a Universal Serial Bus module.

3. The wireless device of claim 1, the shunt stub further comprising a vertical shunt stub.

4. The wireless device of claim 1, the shunt stub further comprising a horizontal shunt stub.

5. The wireless device of claim 1, the module and antenna being mounted on a printed circuit board.

6. A substrate, comprising:

an antenna;

a module to provide signals to be radiated out of the antenna; and a communications port coupled between the antenna and the module to allow the module to provide the signals to be radiated out of the antenna, wherein the antenna comprises:

a radiating portion in a first layer of metal, the radiating portion having multiple folds, a connecting arm coupled between a first end of the radiating portion and the communications port, and a shunt stub, wherein the shunt stub is coupled between the first end of the radiating portion and an extended ground plane in a second layer of metal, the shunt stub having a width that is approximately equal to a width of the radiating portion of the antenna, and wherein the shunt stub is substantially linear.

7. The substrate of claim 6, the multiple folds further comprising folds each being of a substantially equal height.

8. The substrate of claim 6, the multiple folds further comprising folds each being of a substantially equal distance from the other folds.

9. The substrate of claim 6, the multiple folds further comprising folds each having a substantially equal width.

10. The substrate of claim 6, the shunt stub further comprising a vertical shunt stub.

11. The substrate of claim 6, the shunt stub further comprising a horizontal shunt stub.

12. The substrate of claim 6, the radiating portion and the shunt stub being formed out of the first layer of metal.

13. The substrate of claim 6, the shunt stub being connected to the extended ground plane.

14. The substrate of claim 13, the radiating portion in the first layer of metal and the extended ground plane in the second layer of metal being offset a predetermined distance between the layers of metal to provide bandwidth control.

15. A method of manufacturing an antenna, comprising:

forming a first metal layer on a substrate as an extended ground plane;

forming a second metal layer on a substrate;

patterning the second metal layer to form a radiating portion of an antenna having a shunt stub, a connecting arm, and a radiating portion with multiple folds, the shunt stub having a width that is approximately equal to a width of the radiating portion of the antenna, wherein the shunt stub is substantially linear;

forming a connection between the shunt stub and the extended ground plane, wherein the shunt stub is coupled between a first end of the radiating portion and the ground plane; and forming a communications port coupled between the antenna and a module, wherein the connecting arm is coupled between the first end of the radiating portion and the communications port.

16. The method of claim 15, forming a metal layer further comprising forming a top layer of metal.

17. The method of claim 15, forming the metal layer on the substrate further comprising forming the metal layer on the substrate having a bottom layer of metal.

18. The method of claim 15, forming the metal layer further comprising forming a bottom layer of metal.

* * * * *